United States Patent [19]

Morrison

[11] Patent Number: 4,806,047

[45] **Date of Patent: * Feb. 21, 1989**

[54] SCREED FRAME AND STIFFENING APPARATUS

[76] Inventor: Donald R. Morrison, 6228 Eagle Peak Dr., Charlotte, N.C. 28208

[ * ] Notice: The portion of the term of this patent subsequent to Feb. 2, 2005 has been disclaimed.

[21] Appl. No.: 159,262

[22] Filed: Feb. 23, 1988

[51] Int. Cl.[4] ..... E01C 19/22

[52] U.S. Cl. ..... 404/118

[58] Field of Search ..... 404/101, 103, 114, 118, 404/119, 120; 425/456

[56] References Cited

U.S. PATENT DOCUMENTS

| | | | |
|---|---|---|---|
| 4,030,873 | 6/1977 | Morrison | 404/114 X |
| 4,213,749 | 7/1980 | Morrison | 425/456 |
| 4,249,327 | 2/1981 | Allen | 404/114 |
| 4,253,778 | 3/1981 | Morrison | 404/114 |
| 4,261,694 | 4/1981 | Morrison | 425/456 |
| 4,335,976 | 6/1982 | Morrison | 404/114 |
| 4,340,351 | 7/1982 | Owens | 425/456 |
| 4,349,328 | 9/1982 | Allen | 425/456 |
| 4,375,351 | 3/1983 | Allen | 425/456 |
| 4,397,626 | 8/1983 | Morrison | 425/456 X |
| 4,427,358 | 1/1984 | Stilwell | 404/120 X |
| 4,466,757 | 8/1984 | Allen | 404/114 |
| 4,577,994 | 3/1986 | Miller | 404/114 |
| 4,722,638 | 2/1988 | Morrison | 404/119 |

*Primary Examiner*—Jerome W. Massie
*Assistant Examiner*—John F. Letchford
*Attorney, Agent, or Firm*—Olive & Olive

[57] ABSTRACT

The present invention includes a concrete screed frame having a first screed blade, a second screed blade and a camber top member arranged in a triangular cross section. A plurality of frame supports are transversely mounted between the first and second screed blades. A plurality of braces are mounted between the top camber member and the first and second screed blades. A telescoping tube assembly having a first tube and a second tube is mounted transversely between the first and second screed blades at the approximate midpoint of the length of the frame. A pin selectively fixes the relative position of the first and second tubes. Elongated structural means illustrated as a chain assembly is mounted to a screed blade and a tube to stiffen the screed frame and provides a chain-formed truss with the screed frame.

14 Claims, 2 Drawing Sheets

SCREED FRAME AND STIFFENING APPARATUS

Reference to related application: The present application is related to copending U.S. patent application Ser. No. 07/006,508, filed Jan. 22, 1987 entitled "SCREED WITH FRONTAL DISTRIBUTION." now U.S. Pat. No. 4,722,638.

BACKGROUND OF THE INVENTION

1. Field of the Invention

The present invention relates generally to a frame for a concrete screed, and in particular is concerned with a frame stiffening apparatus and a screed frame utilizing such an apparatus.

2. Description of the Related Art

Screeds are well known in the concrete industry. After concrete is poured, a screed is run along the upper surface of the wet concrete to smooth and settle the concrete. Oftentimes, a screed includes a vibrating mechanism to expedite the settlement of the concrete. Representative examples of screeds include U.S. Pat. Nos. 4,030,873 and 4,253,778.

During use, a screed frame may tend to deflect and bend from the resistance of wet concrete as the screed travels along the upper surface. After repeated uses, a frame may be bent beyond repair, thereby prematurely shortening the life of the screed.

The art continues to seek improvements. It is desirable that a screed frame be strong and rigid and resist deflection during use. It is desirable that an apparatus for stiffening a screed frame be economical to install and adaptable to conventional screed frames.

In a copending application, U.S. application Ser. No. 07/006,508 filed Jan. 22, 1987, the present applicant discloses a cable-formed truss for strengthening a concrete screed. It is desirable that an apparatus for stiffening a screed frame cooperate with the cable-formed truss of the above-referenced application.

SUMMARY OF THE INVENTION

The present invention relates to an apparatus for stiffening a screed frame and a screed frame utilizing such an apparatus. The apparatus is economical to install and adaptable to conventional screed frames.

In a preferred embodiment, the present invention includes a screed frame having a first screed blade, a second screed blade and a camber top member arranged in a triangular cross section. A plurality of frame supports are transversely mounted between the first and second screed blades. A plurality of braces are mounted between the top camber member and the first and second screed blades. A telescoping tube assembly having a first tube and a second tube is mounted transversely between the first and second screed blades at the approximate midpoint of the length of the frame. A pin selectively fixes the relative position of the first and second tubes. Elongated structural means illustrated as a chain assembly is mounted to a screed blade and a tube to stiffen the screed frame and provides a chain-formed truss with the screed frame.

DETAILED DESCRIPTION OF THE PREFERRED EMBODIMENT

Figure 1:
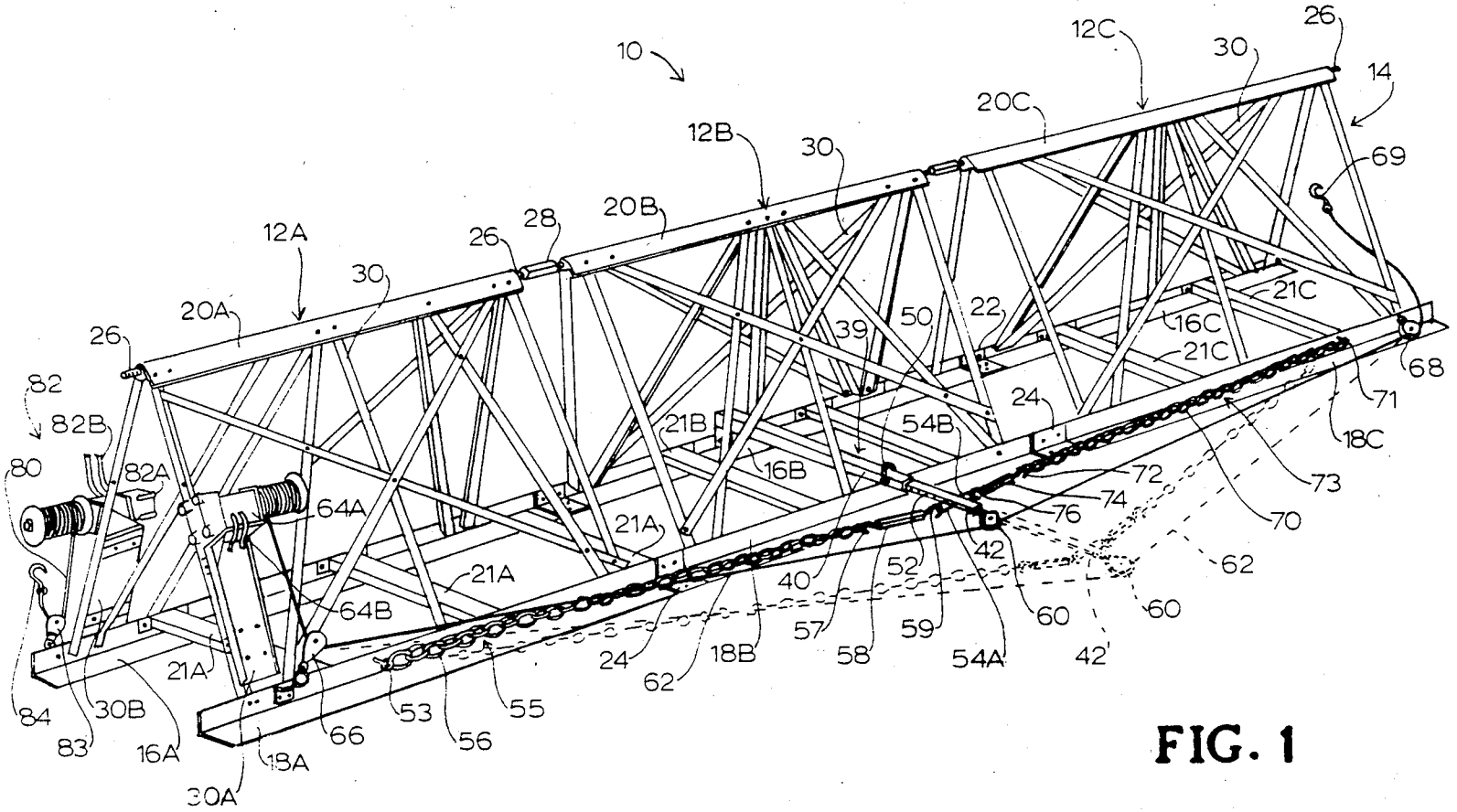
FIG. 1 is a perspective rear view of the present invention illustrating a chain assembly connected to the frame and a telescoping tube extended in a first position, and showing the tube extended in a second position in dotted lines.
Figure 2:
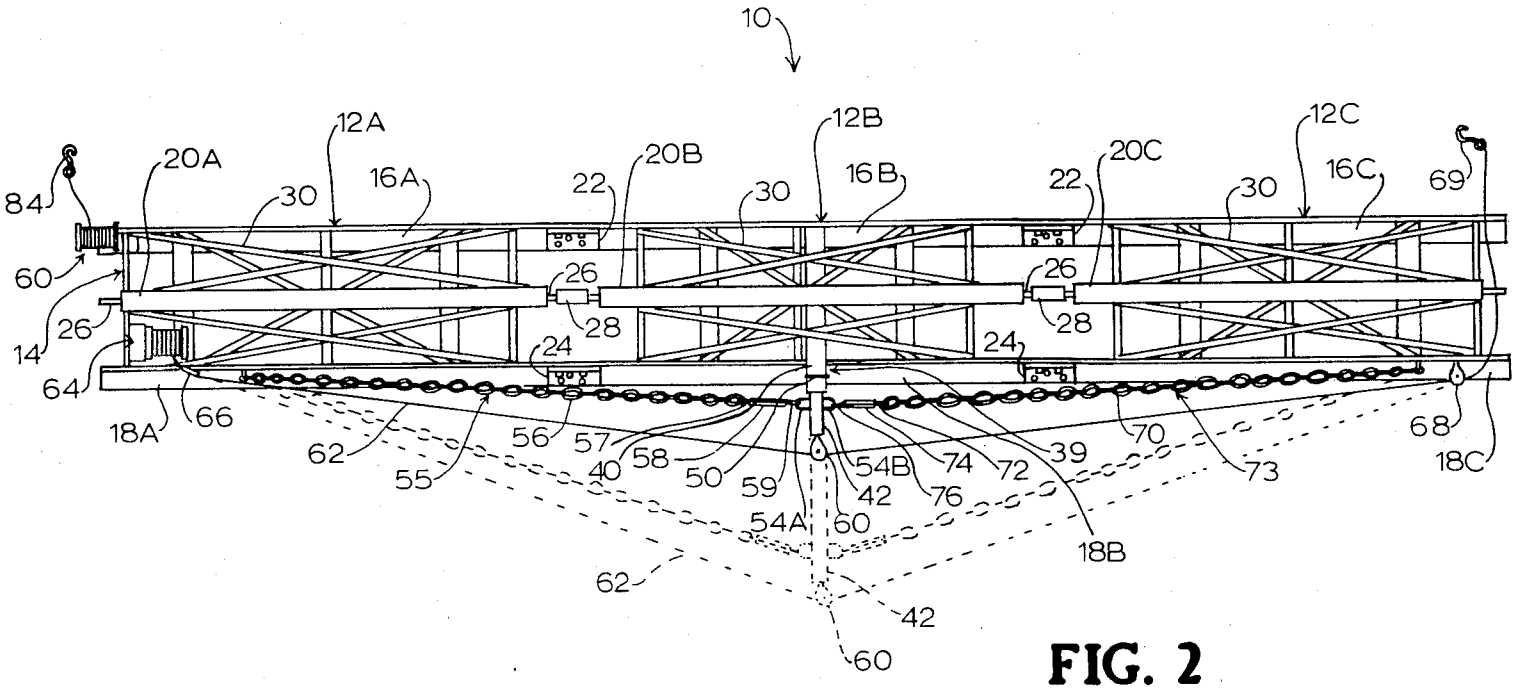
FIG. 2 is a top view of the apparatus of FIG. 1.

A screed apparatus, indicated generally at 10, is illustrated in FIGS. 1 and 2. It is desirable that screed apparatus 10 be formed in sections, e.g., three sections 12A, 12B and 12C, to compensate for the tendency of the screed apparatus 10 to bend and deflect during use. As described below, screed sections 12A–12C are fastened together so that screed apparatus 10 forms an open structural frame 14. It is desirable that frame 14 have a triangular cross section.

Each screed section 12A–12C includes a first screed blade 16A–16C, a second screed blade 18A–18C and a camber top member 20A–20C, respectively. As illustrated in the figures, screed blades 16A–16C form a front or leading edge of screed apparatus 10, while screed blades 18A–18C form a rear or trailing edge of screed apparatus 10. A plurality of longitudinally spaced-apart, transversely-extending frame supports 21A–21C are secured to and between first and second blades 16A–16C, 18A–18C. Plates 22 are secured to screed blades 16A–16C by fasteners or other suitable means. Plates 24 are secured to screed blades 18A–18C by fasteners or other suitable means. Each camber top member 20A–20C is provided with threaded rods 26. Turnbuckle nuts 28 include complementary threaded passages for receiving rods 26. Turnbuckle nuts 28 are threaded on rods 26 to join camber top members 20A–20C. A plurality of braces 30 are secured between the first screed blades 16A–16C and the camber top members 20A–20C and between second screed blades 18A–18C and the camber top members 20A–20C. Braces 30 can be secured by any suitable means, e.g. mechanical fasteners, nut-and-bolt assemblies, welding or the like. Braces 30 rigidify and strengthen frame 14.

In the alternative, it will be understood that screed apparatus 10 can be formed as an integral unit of desired length. Such an embodiment would include a one-piece, unitary first screed blade, a one-piece, unitary second screed blade and a one-piece, unitary camber top member. For example, the camber top member can be provided as an extruded element of desired length. Such an embodiment would not require plates 22, 24, rods 26 and turnbuckle nuts 28.

A tube assembly 39 having coaxial telescoping tubes 40 and 42 is mounted on the screed section 12B at approximately the midpoint of the length of the screed apparatus 10. For purposes of clarity, tube 40 is referred to as "outer tube" while tube 42 is referred to as "inner tube." It will be understood that the tube assembly 39 can be modified to alternate the outer tube 40 and the inner tube 42. Outer tube 40 is provided with mounting flanges (not illustrated) which are joined by suitable mechanical fasteners to the first and second screed blades 16B, 18B. In an embodiment of the screed apparatus 10 having unitary screed blades, telescoping tubes 40 and 42 are mounted near the midpoint of the length of the apparatus 10.

Outer tube 42 includes a removable quick pin 50 insertable through the sides of tubes 40 and 42. Inner telescoping tube 42 includes a series of openings 52 along its side surfaces. Openings 52 receive quick pin 50 to fix the relative positions of tubes 40, 42. The legs of quick pin 50 pass through the outer tube 40 and into selected openings 52 of the inner tube 42. By removing and inserting quick pin 50, inner tube 42 can be retracted into or extended from outer tube 40.

A pulley 60 is mounted on the end of inner tube 42 opposite outer tube 40. Pulley 60 receives a cable 62 which is used in conjunction with a winch assembly 64 for advancing the screed apparatus 10 along the length of a concrete surface. Winch assembly 64 can include a hydraulic motor 64A and supply hoses 64B in communication with a reservoir (not illustrated). Winch assembly 64 can be mounted on a support 30A as illustrated or any convenient location on frame 14. Cable 62 is routed through pulley 66 secured to screed blade 18A and pulley 68 secured to screed blade 18C. A slip hook 69 is provided on the end of cable 62 opposite winch assembly 64.

A second cable 80 and winch assembly 82 mounted on the frame 14 at support 30B can be utilized with cable 62 and winch assembly 64. Winch assembly 82 can include a hydraulic motor 82A and supply hoses 82B in communication with a reservoir (not illustrated). It is desirable that winch assembly 82 be mounted on frame 14 so that cable 80 pass through a pulley 83 mounted on screed blade section 16A as illustrated. A slip hook 84 is provided on cable 80. Slip hooks 69 and 84 can be attached to selected, fixed objects in the direction of travel of the screed apparatus 10.

Hook elements 54A and 54B are provided on the side surfaces of inner tube 42 between openings 52 and pulley 60. A first chain assembly 55 includes a first chain 56 removably secured at a first end to screed blade 18A at eyehole hook 53. At its second end, chain 56 is connected to a hook element 57 of a turnbuckle 58. A second hook element 59 of turnbuckle 58 is removably connected to hook element 54A.

A second chain assembly 73 includes a chain 70 removably secured at its first end to screed blade 18C at eyehole hook 71. At its second end, chain 70 is removably connected to a first hook element 72 of a turnbuckle 74. A second hook element 76 of turnbuckle 74 is removably connected to hook element 54B.

In use, slip hooks 69 and 84 are secured to fixed posts, stakes or the like positioned in the direction of travel desired for the screed apparatus 10. The screed apparatus 10 is advanced as cables 62 and 80 are wound about drums of winch assemblies 64 and 82. During travel, frame 14 tends to bend and deflect from the resistance of rough and wet concrete in contact with the screed blades 16A–16C and 18A–18C. Chains 56, 70, connected to the frame 14 by turnbuckles 58, 74 and hook elements 54A and 54B, stiffen and strengthen the frame 14, thereby reducing bending and deflection. Thus, the chain assemblies 55 and 73 provide a means for strengthening and stiffening the frame 14, thereby extending the life of the frame 14. Chain assemblies 55, 73 in effect form a truss with the frame 14 to augment the truss formed by cable 62.

It is preferred that the length of inner tube 42 be greater than the width of frame 14 so that the inner tube 42 extends at least a small length beyond the width of the frame 14 when the inner tube 42 is fully retracted into the outer tube 30 40. When the inner tube 42 is fully extended as illustrated in dotted lines in FIGS. 1 and 2, pulley 60 is positioned at a point at least twice the width of the frame 14 from screed blade 18B.

It is preferred that chains 56 and 70 be formed from links as illustrated in FIGS. 1 and 2. The breaking strength and tensile strength of each chain 56 and 70 is sufficient to resist bending of the frame 14 during advancement of the screed apparatus 10.

Prior to advancement, tube assembly 39 is extended to reduce slack in chains 56 and 70. Turnbuckles 58 and 74 are tightened to further reduce slack in chains 56 and 70. As the screed apparatus 10 is advanced by winch assemblies 64 and 82, deflection in the frame 14 establishes a truss effect between frame 14 and chain assemblies 55 and 73.

It will be understood that a cable, a bar or the like can be substituted for each chain 56 and 70. Such an element should be of sufficient tensile strength to resist breaking as the element is loaded during advancement of the screed apparatus 10.

Although the present invention has been described with reference to a preferred embodiment, persons skilled in the art will recognize that changes may be made in form and detail without departing from the spirit and scope of the invention.

What is claimed is:

1. A frame for a concrete screed comprising:

(a) a frame assembly;

(b) a tube assembly mounted on the frame assembly transversely to the length of the frame assembly; and (c) elongated structural means removably connected to the frame assembly and the tube assembly for forming a truss with the frame assembly prior to advancement and for stiffening the frame as the frame is advanced during a screeding operation.

2. The frame as specified in claim 1 wherein the tube assembly is mounted approximately midway of the length of the frame assembly.

3. The frame as specified in claim 1 wherein the elongated structural means spans substantially the length of the frame assembly.

4. The frame as specified in claim 1 wherein the frame assembly includes a triangular cross section.

5. The frame as specified in claim 1 wherein the frame assembly comprises a plurality of frame sections.

6. The frame as specified in claim 1 wherein the tube assembly comprises at least first and second tube members.

7. The frame as specified in claim 6 wherein the tube members are telescopic.

8. The frame as specified in claim 7 wherein the tube assembly includes means for selectively fixing the relative position of the tube members.

9. The frame as specified in claim 6 wherein the frame assembly comprises:

(a) a first screed blade;

(b) a second screed blade;

(c) a plurality of frame supports transversely mounted between the first and second screed blades;

(d) a camber top member; and (e) a plurality of brace elements mounted between the camber top member and the first and second screed blades.

10. The frame as specified in claim 9 wherein the elongated structural means comprises:

(a) a first chain connected at a first end to the second screed blade and connected at a second end to a tube member; and (b) a second chain connected at a first end to the second screed blade and connected at a second end to a tube member.

11. The frame as specified in claim 10 including a turnbuckle connected between each chain and the tube member.

12. A frame for a screed comprising:

(a) a frame assembly including (i) a pair of parallel screed blades having a plurality of frame supports mounted transversely between the screed blades;

(ii) a camber top member, parallel to the screed blades and joined to the screed blades by a plurality of braces to form a triangular cross section;

(iii) a telescoping tube assembly having at least first and second tube elements, the tube assembly mounted transversely between the screed blades wherein the tube assembly has a retracted length at least equal to the width of the frame; and (iv) means for selectively fixing the relative position of the tube elements; and (b) an elongated structural assembly removably connected to the frame assembly and the tube assembly for forming a truss with the frame assembly.

13. The frame as specified in claim 12 wherein the elongated structural assembly comprises:

(a) a first chain assembly having a chain connected to a screed blade and a tube element; and (b) a second chain assembly having a chain connected to a screed blade and a tube element opposite the first chain assembly.

14. The frame as specified in claim 13 including a cable removably connected to the frame assembly and the tube assembly for forming a secondary truss with the frame assembly when the frame assembly is advanced by the cable.

* * * * *